United States Patent [19]

Blair

[11] 4,004,814

[45] Jan. 25, 1977

[54] HORIZONTALLY SWINGABLE GOLF TEE

[75] Inventor: C. Lee Blair, Seymour, Ind.

[73] Assignee: The Raymond Lee Organization, Inc., a part interest

[22] Filed: Nov. 25, 1975

[21] Appl. No.: 635,119

[52] U.S. Cl. ..... 273/204

[51] Int. Cl.[2] ..... A63B 57/00

[58] Field of Search ..... 273/204, 206, 212, 33, 273/184 B, 196, 197 R, 197 A, 198, 200

[56] References Cited

UNITED STATES PATENTS

| | | | |
|---|---|---|---|
| 1,765,518 | 6/1930 | Williams | 273/200 R |
| 1,839,040 | 12/1931 | McCarrier | 273/204 |
| 1,959,347 | 5/1934 | Czichos | 273/212 |
| 2,509,166 | 5/1950 | Phillips et al. | 273/204 |
| 2,510,266 | 6/1950 | Taylor | 273/197 R |
| 3,643,961 | 2/1972 | Schroder | 273/197 R |

FOREIGN PATENTS OR APPLICATIONS

| | | | |
|---|---|---|---|
| 25,767 | 11/1907 | United Kingdom | 273/204 |

*Primary Examiner*—Richard C. Pinkham
*Assistant Examiner*—T. Brown

[57] ABSTRACT

A golf tee employs an elongated vertical element having a lower pointed end and a vertical axially disposed bore extending downward from the upper end to a point intermediate the ends. A pin has an enlarged horizontal head and a shaft extending vertically downward from said head. The shaft is disposed in fixed position in said bore with the head disposed above the upper end of the element. A first horizontal ring engages the shaft and is disposed between the head of the pin and the upper end of the element. The first ring is rotatable about the shaft. A second horizontal ring larger in diameter than the first ring has a central opening adapted to receive removably a bottom portion of a golf ball. A horizontally elongated member composed of a plurality of inter-twisted strands is secured at one end to the periphery of the first ring, the other end of the member being secured to the periphery of the second ring.

1 Claim, 3 Drawing Figures

HORIZONTALLY SWINGABLE GOLF TEE

BACKGROUND OF THE INVENTION

Various types of golf tees are known wherein a generally horizontal swivel arm is secured at one end to the upper end of a vertical anchoring peg and is provided at the other end with means for supporting a golf ball. Such types are shown for example in the following U.S. patents: No. 3,424,457; No. 1,800,647; No. 2,466,115; and No. 2,277,918.

This invention relates to a golf tee of this type characterized by greater flexibility and durability. The tee in accordance with this invention, moreover, utilizes a new type of pivotal connection which promotes ease of rotation and is much less costly to produce than known golf tees of the type described above.

SUMMARY OF THE INVENTION

A golf tee in accordance with the invention employs an elongated vertical element having a lower pointed end and a vertical axially disposed bore extending downward from the upper end to a point intermediate the ends.

A pin has an enlarged horizontal head and a shaft extending vertically downward from said head. The shaft is disposed in fixed position in said bore with the head disposed above the upper end of the element. A first horizontal ring engages the shaft and is disposed between the head of the pin and the upper end of the element. The first ring is rotatable about the shaft. A second horizontal ring larger in diameter than the first ring with a central opening is adapted to receive removably a bottom portion of a golf ball. A horizontally elongated member composed of a plurality of intertwisted strands, is secured at one end of the member to the periphery of the first ring. The other end of the member is secured to the periphery of the second ring.

The member is sufficiently rigid to function as a ball support yet is sufficiently flexible to absorb the shocks of being struck properly or improperly by a golf club whereby breakage or other damage will normally not occur. Moreover the rotatable connection established between the first ring and shaft minimizes friction and permits great ease of rotation. This arrangement further increases the resistance of the invention to shocks and further reduces risk of breakage or other damage.

DETAILED DESCRIPTION OF PREFERRED EMBODIMENTS

Figure 1:
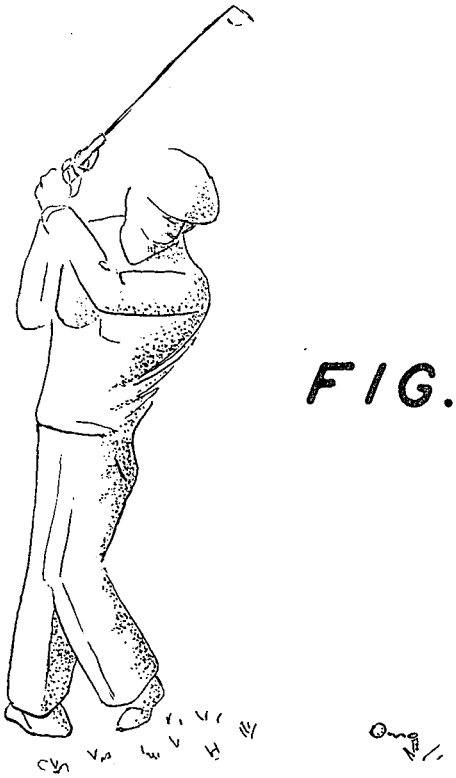
FIG. 1 shows the invention in use.
Figure 2:
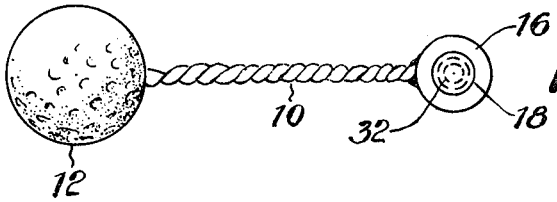
FIG. 2 is a top view of the invention.
Figure 3:
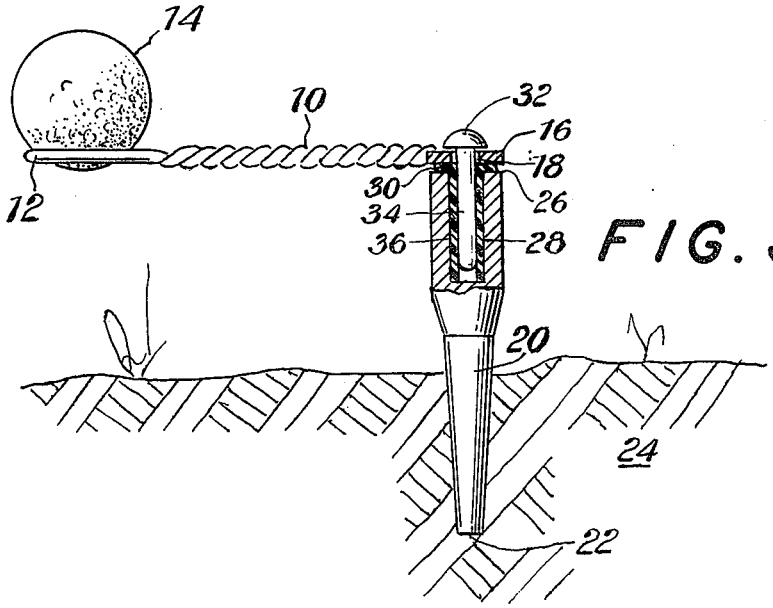
FIG. 3 is a side view of the invention.

Referring now to FIGS. 1–3, a single length of hard galvanized steel were is twisted upon itself to produce a horizontally elongated member 10 having a horizontal ring or loop 12 at one end. The opening in loop 12 is large enough to removably receive a small bottom portion of a golf ball 14. The other end of member 10 is welded or otherwise secured to the periphery of a second and much smaller horizontal metal ring or washer 16. The center opening of ring 16 contains a spinning bearing 18.

A vertical element 20 made of hard wood has a lower pointed end 22 which can be forced into the ground 24 leaving its upper end 26 exposed. A vertical axially disposed bore 28 in element 20 extends downwards from end 26 to a point intermediate the end. A hollow metal tube 36 is disposed fixedly in the bore with an outwardly disposed lip 30 resting on the top of end 26. A metal pin with enlarged head and downwardly disposed shaft 34 has shaft 34 extending through bearing 18 into tube 28. The member 18 is thus freely rotatable in a horizontal plane about the pin.

This rotational arrangement has minimum friction. Member 10 because of the inter twisted strand construction is sufficiently rigid to support the ball as desired and yet is sufficiently flexible to absorb the shocks.

I claim:

1. A golf tee comprising:

an elongated vertical wooden element having a lower pointed end and a vertical axially disposed bore extending downwardly from the upper end to a point intermediate the ends;

a metal pin having an enlarged horizontal head and a shaft extending vertically downwardly from said head, said shaft being disposed in fixed position in said bore with the head disposed above the upper end of the element;

a hollow metal tube disposed in the bore and receiving said shaft;

a first horizontal metal ring encircling the shaft below said head and above the top end of the tube in bearing relationship therewith; and a single continuous length of metal wire, said length being bent into a second horizontal ring portion larger in diameter than the first ring with a central opening adapted to support a golf ball, the remaining portion said length being of inter-twisted strands to form a horizontally elongated arm attached to and extending radially outwardly from the second horizontal ring, said arm being attached at its radially outward end to the periphery of the first horizontal ring.

* * * * *